US007785068B2

(12) United States Patent
Rao K V et al.

(10) Patent No.: US 7,785,068 B2
(45) Date of Patent: Aug. 31, 2010

(54) STEAM TURBINE EXHAUST HOOD AND METHOD OF FABRICATING THE SAME

(75) Inventors: Hayagreeva Rao K V, Andhra Pradesh (IN); Prashant Shukla, Bangalore (IN); Adi Narayana Namburi, Bangalore (IN); Chinniah Thiagarajan, Karnataka (IN)

(73) Assignee: General Electric Company, Schenectady, NY (US)

( * ) Notice: Subject to any disclaimer, the term of this patent is extended or adjusted under 35 U.S.C. 154(b) by 751 days.

(21) Appl. No.: 11/804,096

(22) Filed: May 17, 2007

(65) Prior Publication Data

US 2008/0286099 A1 Nov. 20, 2008

(51) Int. Cl.
*F01D 25/00* (2006.01)

(52) U.S. Cl. ..... 415/200; 415/213.1; 415/226; 29/888.025

(58) Field of Classification Search ..... 415/1, 415/108, 200, 213.1, 226; 29/888.025
See application file for complete search history.

(56) References Cited

U.S. PATENT DOCUMENTS

| | | | | |
|---|---|---|---|---|
| 3,149,470 | A | 9/1964 | Herzog | |
| 3,520,634 | A | 7/1970 | Bellati et al. | |
| 3,630,635 | A | 12/1971 | Fatum | |
| 3,942,907 | A * | 3/1976 | Meylan | 415/126 |
| 4,102,598 | A * | 7/1978 | Stock et al. | 415/135 |
| 4,326,832 | A | 4/1982 | Ikeda et al. | |
| 5,290,146 | A | 3/1994 | Erber | |
| 6,419,448 | B1 * | 7/2002 | Owczarek | 415/207 |
| 6,837,673 | B2 * | 1/2005 | Ootoshi et al. | 415/1 |
| 6,971,842 | B2 | 12/2005 | Luniewski et al. | |
| 2005/0063821 | A1 | 3/2005 | Luniewski et al. | |
| 2007/0081892 | A1 * | 4/2007 | Sharrow | 415/211.2 |

* cited by examiner

*Primary Examiner*—Igor Kershteyn
(74) *Attorney, Agent, or Firm*—Armstrong Teasdale LLP

(57) ABSTRACT

A method of fabricating an exhaust hood is provided for use with a turbine engine. The method includes providing an upper shell casing wherein the upper shell casing is fabricated from a composite material, and coupling the upper shell casing to a lower shell casing such that a turbine is housed within the exhaust hood, the shell casing is fabricated from a composite material. A turbine assembly is also provided.

20 Claims, 5 Drawing Sheets

STEAM TURBINE EXHAUST HOOD AND METHOD OF FABRICATING THE SAME

BACKGROUND OF THE INVENTION

This invention relates generally to steam turbines, and more particularly, to an exhaust hood used with a steam turbine.

At least some known power plants include a low pressure steam turbine (LP) coupled to an intermediate pressure (IP) and/or high pressure (HP) steam turbine to drive a generator. Within known LP turbines, expended steam is channeled into an exhaust hood from the LP turbine. The LP turbine exhaust hood facilitates separating steam under vacuum from atmospheric conditions, while providing support to rotating and stationary turbine components. As is known, the stationary components generally direct the steam towards the rotating components at a pre-determined angle to facilitate rotor rotation and thus, power generation.

At least one known LP turbine exhaust hood is fabricated from a plurality of complex plate metal shapes coupled together to form a shell assembly. The shell assembly is then machined to facilitate an interface between internal and external components used for steam turbine construction. The upper and lower halves of the exhaust hood are then coupled together along a horizontal joint to form the exhaust hood.

At least one known LP turbine exhaust hood is fabricated solely from steel material. Although such hoods may be more structurally sound than other known hoods, such exhaust hoods are heavy and may be awkward to assemble and move, because of the weight, the cost of manufacturing and transporting the exhaust hood is also increased in comparison to other known hoods.

BRIEF DESCRIPTION OF THE INVENTION

In one aspect, an exhaust hood for use with a turbine engine is provided. The method includes providing an upper shell casing wherein the upper shell casing is fabricated from a composite material, and coupling the upper shell casing to a lower shell casing such that a turbine is housed within the exhaust hood, the shell casing is fabricated from a composite material.

In another aspect, an exhaust hood for a turbine is provided. A turbine exhaust hood is provided. The exhaust hood includes a shell casing sized to house a turbine at least partially therein. The shell casing is fabricated from a composite material.

In another aspect, a turbine assembly is provided. The turbine assembly includes a turbine and an exhaust hood. The turbine is housed at least partially within the exhaust hood. The exhaust hood includes a shell casing. The shell casing includes a radially inner surface and a radially outer surface. The shell casing is fabricated from a composite material. The exhaust hood further includes an external support structure coupled to the shell casing outer surface. The external support structure provides structural support to the shell casing. The exhaust hood further includes an internal support structure coupled to the shell casing inner surface for channeling flow into the exhaust hood.

DETAILED DESCRIPTION OF THE INVENTION

Figure 1:
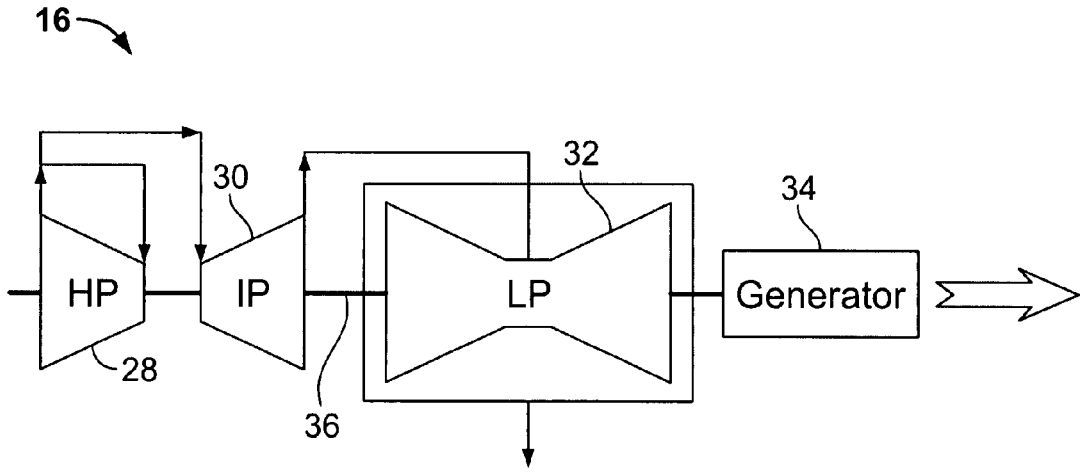
FIG. 1 is a schematic view of an exemplary steam turbine assembly.

FIG. 1 is a schematic view of an exemplary steam turbine assembly 16. In the exemplary embodiment, steam turbine assembly 16 includes a High Pressure (HP) turbine section 28, an Intermediate Pressure (IP) turbine section 30, and a Low Pressure (LP) turbine section 32. In the exemplary embodiment, steam turbine assembly 16 is coupled to a generator 34 via a shaft 36.

In the exemplary embodiment, steam turbine assembly 16 is an opposed-flow high pressure and intermediate pressure steam turbine combination. Alternatively, steam turbine assembly 16 may be used with any individual turbine including, but not being limited to low pressure turbines. In addition, the present invention is not limited to being used with opposed-flow steam turbines, but rather may be used with steam turbine configurations that include, but are not limited to single-flow and double-flow turbine steam turbines.

During operation, steam is channeled into an inlet or HP turbine section 28. A portion of the steam from HP turbine section 28 is channeled into an inlet of IP turbine section 30. Steam temperature and pressure decrease as the steam expands through IP turbine section 30 and is channeled into IP turbine section 32.

Figure 2:
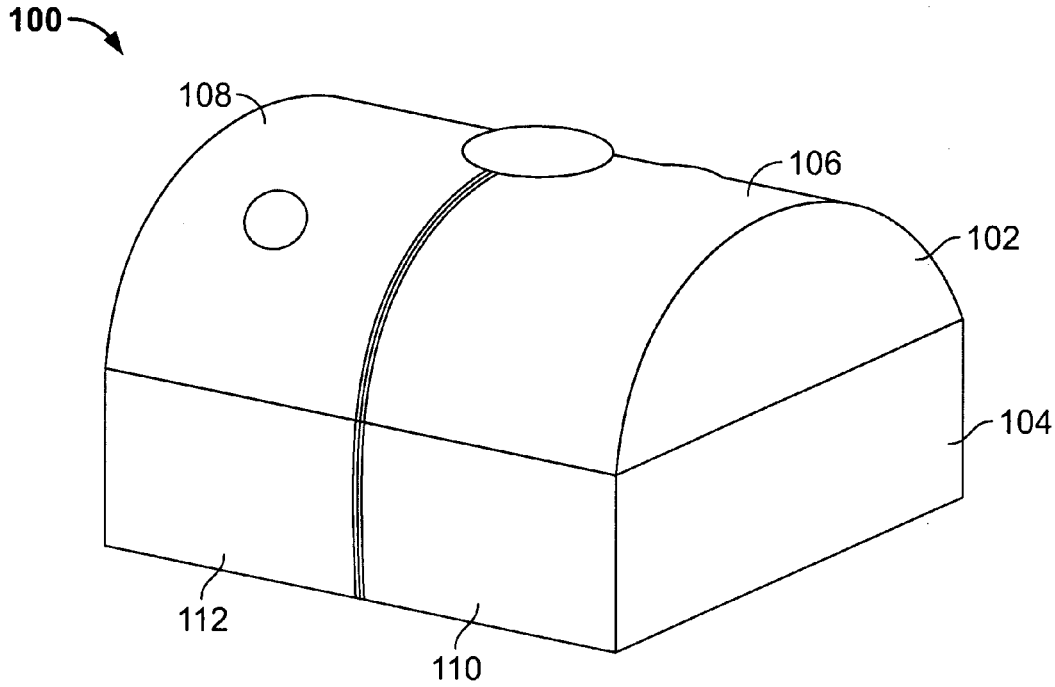
FIG. 2 is a schematic illustration of an exemplary exhaust hood that may be used with the steam turbine assembly shown in FIG. 1.
Figure 3:
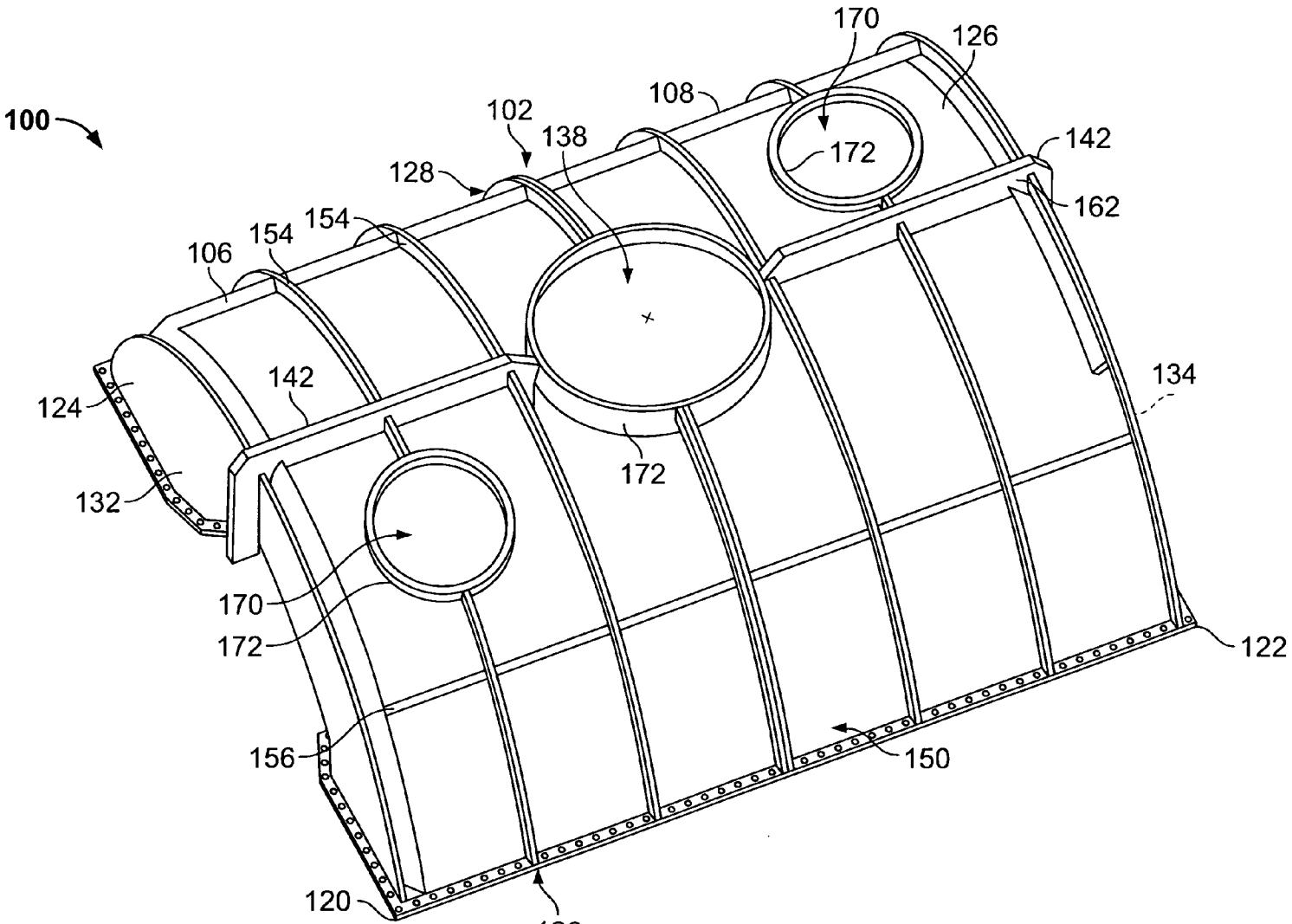
FIG. 3 is a perspective view of an upper half of the exhaust hood shown in FIG. 2.

FIG. 2 is a schematic illustration of an exemplary exhaust hood 100 that may be used with steam turbine assembly 16. FIG. 3 is a perspective view of an upper half of exhaust hood 100. In the exemplary embodiment, exhaust hood 100 includes an upper shell assembly 102 that is coupled to a lower base shell assembly 104. Upper shell assembly 102 includes a first shell portion 106 and a second shell portion 108. In an alternative embodiment, upper shell assembly 102 is of unitary construction and is formed integrally with both shell portions 106 and 108. Lower base shell assembly 104 includes a first base shell portion 110 and a second base shell section 112. In an alternative embodiment, lower base shell assembly 104 is of unitary construction and is formed integrally with both shell portions 110 and 112.

Upper shell assembly 102 extends generally axially between a first end 120 and a second end 122, and generally laterally between a pair of opposite sides 124 and 126. Ends 120 and 122, and sides 124 and 126 form a frame assembly 128. In the exemplary embodiment, frame assembly 128 includes a plurality of openings (not shown) defined therein that are each sized to receive a mechanical coupling device (not shown) therethrough to facilitate assembly and disassembly of upper shell assembly 102 and lower base shell assembly 104. Upper shell assembly 102 also includes a first substantially semi-circular shaped end cover 132 and an opposite second substantially semi-circular shaped end cover 134. More specifically, end covers 132 and 134 are each coupled to frame assembly 128 at opposite ends 120 and 122 of upper shell assembly 102. More specifically, each cover 132 and 134 is positioned substantially concentrically with respect to an axis of symmetry extending axially between covers 132 and 134 through upper shell assembly 102.

Upper shell assembly 102 also includes an opening or steam inlet 138 that extends therethrough. In the exemplary embodiment, opening 138 is aligned substantially concentrically with respect to axis of symmetry 136. Moreover, in the exemplary embodiment, steam from IP turbine section 30 (shown in FIG. 1) flows through opening 138 towards LP turbine section 32 (shown in FIG. 1). Opening 138 is also substantially concentrically aligned with respect to a center rib 142 that extends between end covers 132 and 134, and along axis of symmetry 136. More specifically, rib 142 does not extend continuously axially between end covers 132 and 134, but rather extends from each respective end cover 132 and 134 to opening 138.

A shell casing 150 extends across exhaust hood 100. More specifically, shell casing 150 extends axially between exhaust hood first and second ends 120 and 122, respectively, and laterally between exhaust hood sides 124 and 126. An external support frame (not shown) extends across an outer periphery of shell casing 150 and includes a plurality of arcuate lateral support ribs 154 and a plurality of axial support ribs 156. The external support frame is also coupled to center rib 142. Rib 142 is oriented such that at least a portion of rib 142 extends radially inward from casing 150 to provide structural support to casing 150. Notably, rib 142 provides structural support to casing 150 while impeding steam flow within hood 100 less than other ribs used with other known exhaust hoods. In one embodiment, rib 142 extends only approximately three inches radially inward from shell casing 150.

The external support frame provides additional structural support to shell casing 150. In the exemplary embodiment, lateral support ribs 154 are spaced substantially equidistantly between hood ends 120 and 122, and extend laterally between hood sides 124 and 126. Moreover, in the exemplary embodiment, adjacent ribs 154 are substantially parallel to each other. Accordingly, the main structural support provided to shell casing 150 is through externally-mounted structural supports.

More specifically, in the exemplary embodiment, axial support ribs 156 are spaced substantially equidistantly between hood first side 124 and second side 126, and extend substantially axially between hood ends 120 and 122. Moreover, in the exemplary embodiment, support ribs 154 and 156 are coupled together in a lattice-shaped arrangement. It should be noted that the size, location, number, and type of ribs 154 and 156 are variably selected to facilitate providing structural support to hood 100, as described herein.

Exhaust hood 100 also includes a plurality of access ports or marbles 170. Access ports 170, in the exemplary embodiment, are positioned along each side of center rib 142 to provide access into hood 100. More specifically, ports 170 are positioned between support ribs 154 and 156 to enable an operator to enter an inner portion of exhaust hood 100 without contacting support ribs 154 and 156 respectively. Moreover, in the exemplary embodiment, opening 138 and each access port 170 includes at least one support ring 172 that is positioned along a first side 162 of center rib 142.

Figure 4:
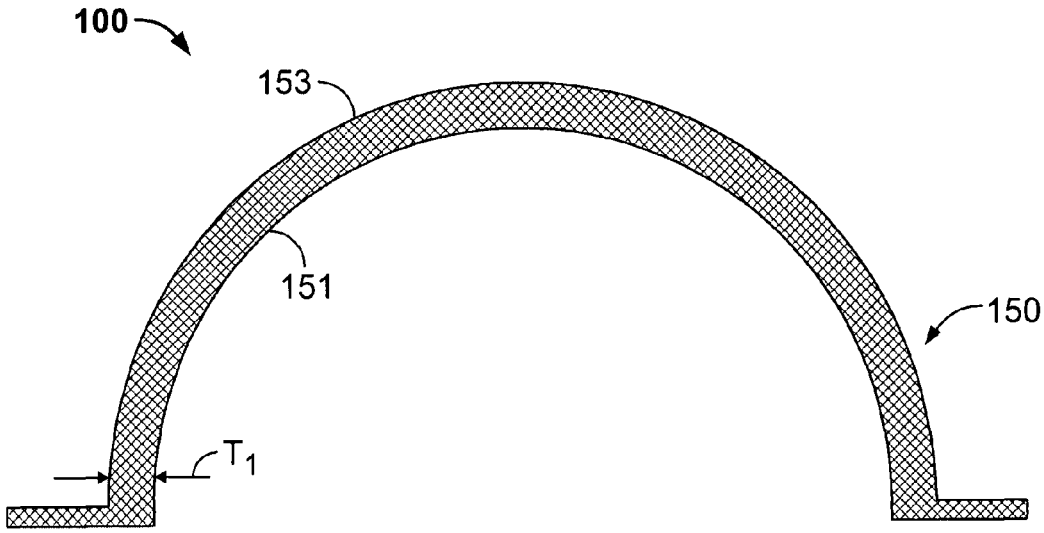
FIG. 4 is a cross-sectional view of an alternative upper half of an exhaust hood that may be used with the steam turbine assembly shown in FIG. 1.
Figure 5:
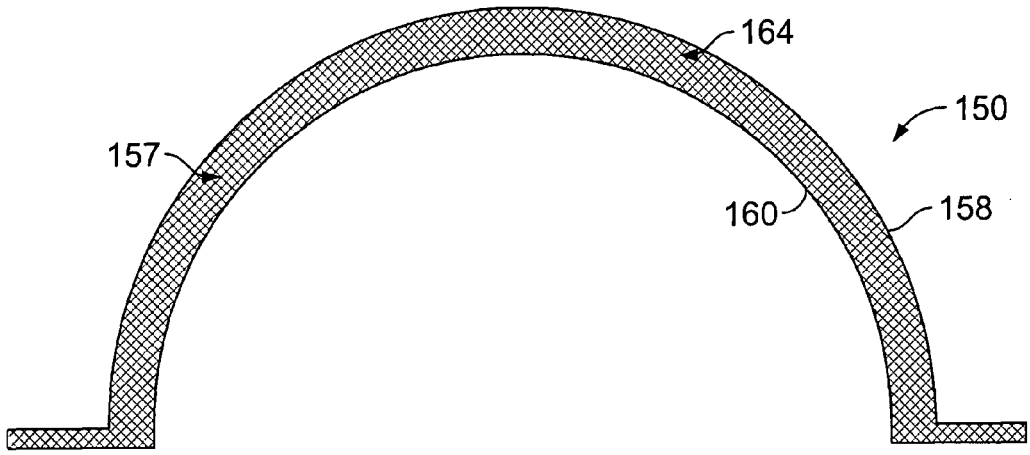
FIG. 5 is a cross-sectional view of another alternative upper half of an exhaust hood that may be used with the steam turbine assembly shown in FIG. 1.
Figure 6:
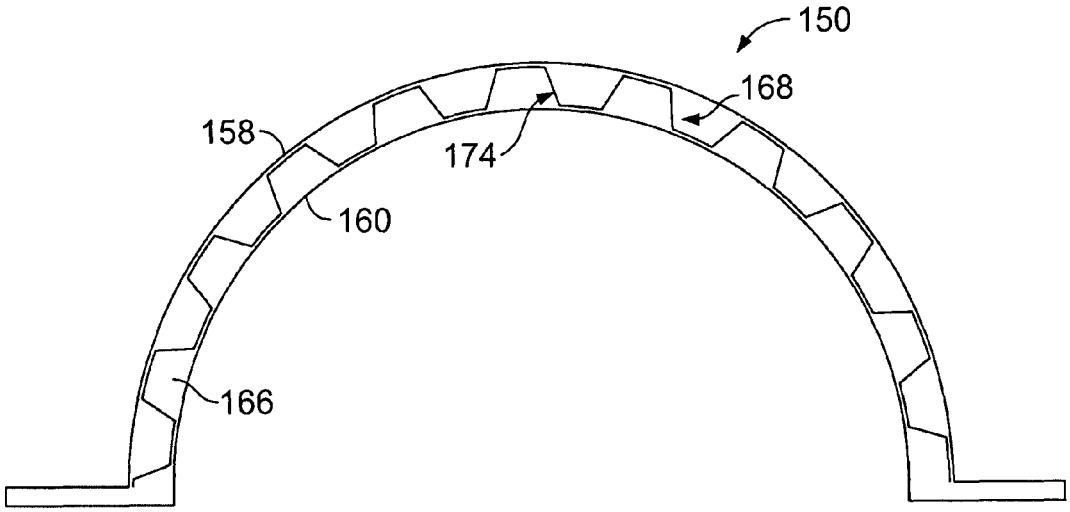
FIG. 6 is a cross-sectional view of a further alternative upper half of an exhaust hood that may be used with the steam turbine assembly shown in FIG. 1.
Figure 7:
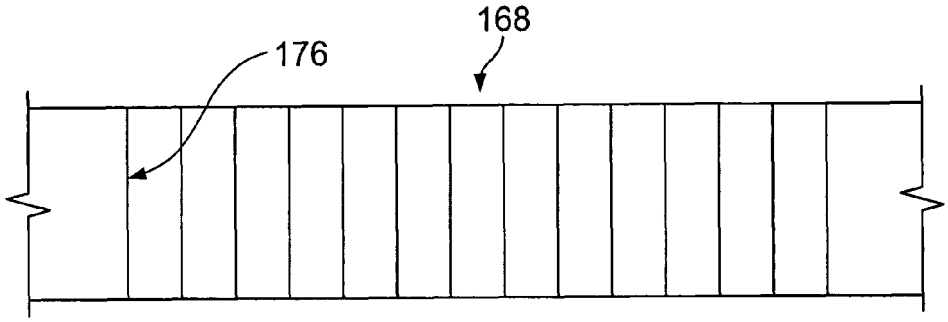
FIG. 7 is an enlarged cross-sectional view of a portion of the reinforcing composite material used within the upper half of the exhaust hood shown in FIG. 6.
Figure 8:
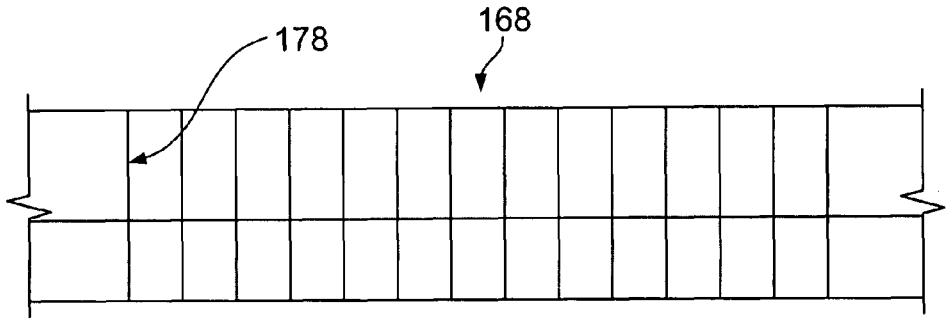
FIG. 8 is an enlarged cross-sectional view of an alternative portion of the reinforcing composite material used within the upper half of the exhaust hood shown in FIG. 6.
Figure 9:
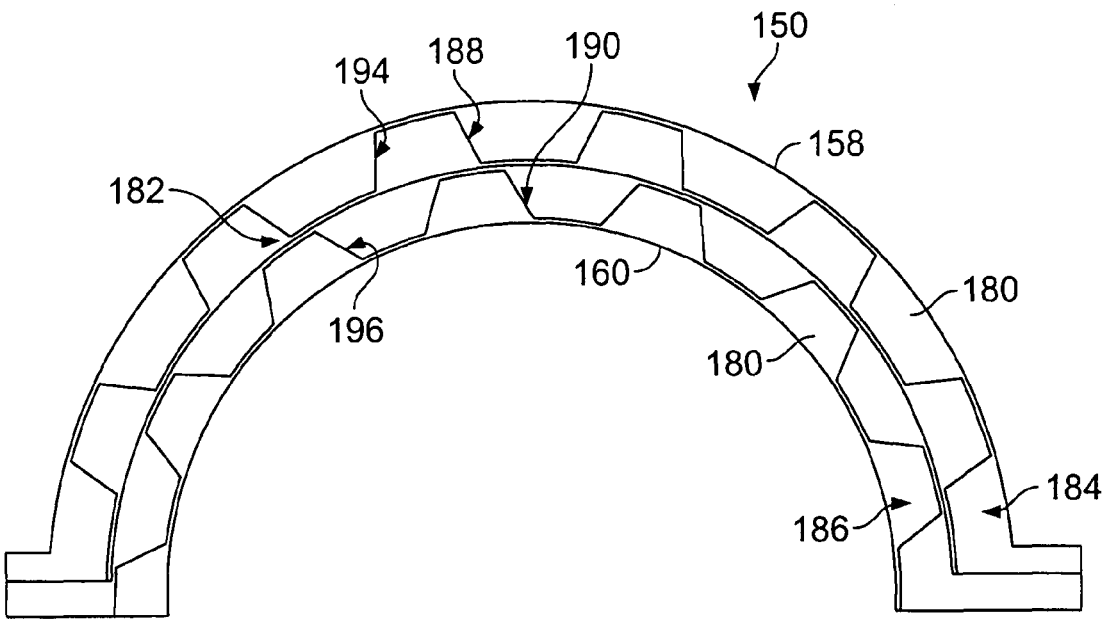
FIG. 9 is a cross-sectional view of yet another alternative upper half of an exhaust hood that may be used with the steam turbine assembly shown in FIG. 3.
Figure 10:
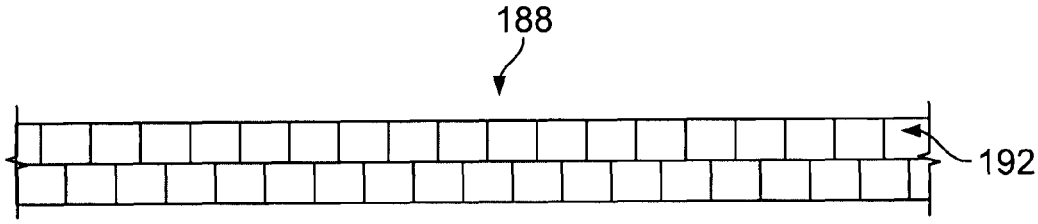
FIG. 10 is a cross-sectional view of a portion of the reinforcing composite material positioned within the upper half of the exhaust hood shown in FIG. 9.

FIG. 4 is a cross-sectional view of an alternative upper half of exhaust hood 100, FIG. 5 is a cross-sectional view of another alternative upper half of exhaust hood 100, and FIG. 6 is a cross-sectional view of a further alternative upper half of exhaust hood 100. FIG. 7 is an enlarged cross-sectional view of a portion of the reinforcing composite material used within the upper half of exhaust hood 100 shown in FIG. 6, and FIG. 8 is an enlarged cross-sectional view of an alternative portion of the reinforcing composite material used within the upper half of exhaust hood 100 shown in FIG. 6. FIG. 9 is a cross-sectional view of yet another alternative upper half of an exhaust hood that may be used with the steam turbine assembly shown in FIG. 3, and FIG. 10 is a cross-sectional view of a portion of the reinforcing composite material positioned within the upper half of the exhaust hood shown in FIG. 9.

As shown in FIG. 4, in the exemplary embodiment, shell casing 150 extends across exhaust hood 100. Shell casing 150 includes a radially inner surface 151 and an opposing radially outer surface 153. Moreover, shell casing 150 extends axially between exhaust hood first and second ends 120 and 122 (shown in FIG. 3), respectively, and laterally between exhaust hood sides 124 and 126 (shown in FIG. 3).

In the exemplary embodiment, shell casing 150 is fabricated from a composite material. More specifically, in the exemplary embodiment, shell casing 150 is fabricated of a composite material that facilitates reducing an overall weight of shell casing 150 in comparison to known shell casings. Specifically, in the exemplary embodiment, shell casing 150 is fabricated from a glass fiber composite. In an alternative embodiment, the composite is fabricated from another material such as, but not limited to, a carbon fiber and matrix based composite material, an aramid fiber-based, Thermoset composite material, thermoplastic composite material, a polymer fiber-based Thermoset matrix composite material, and/or a polymer fiber-based thermoplastic matrix composite material, and/or any combination of such materials.

Moreover, in the exemplary embodiment, when shell casing 150 is fabricated from composite material, any opening, for example opening 138, formed within shell casing 150 may require additional local structural support and stiffening. The structural support for opening 138 may be a support ring that is positioned along the periphery of the opening. Alternatively, the structural support for opening 138 may be any support that facilitates enabling casing 150 to function as described herein. The structural support will facilitate preventing local buckling of shell casing 150 around opening 138.

In the exemplary embodiment, illustrated in FIG. 4, shell casing 150 is fabricated from a composite material having a thickness $T_1$ that is approximately twice the thickness of a standard steel shell casing. For example, thickness $T_1$ may range from approximately 0.5 to 4 inches. Moreover, in the exemplary embodiment, shell casing 150 may also include a sheet liner (not shown) coupled to, and extending over, at least a portion of radially inner surface 151. In the exemplary embodiment, the sheet liner is fabricated from a steel material and when installed, facilitates preventing water absorption and degradation of the composite material 157 used in fabricating shell casing 150.

As shown in FIG. 5, shell casing 150 includes a radially outer skin 158 and a radially inner skin 160 that each extend over a composite material 157, such that the composite material 157 is essentially sandwiched between skins 158 and 160. In one embodiment, the composite material 157 is a foam material 164. Skins 158 and 160 can be fabricated from any suitable material such as, but not limited to, a steel material, aluminum, Carbon fiber pre-preg based laminates, Hybrid steel and aluminum, titanium, high-performance polymer, and ceramic material coated sheets that facilitates protecting foam material 164 from degradation and that provides structural strength to shell casing 150. In the exemplary embodiment, foam material 164 includes at least one of, but is not limited to including, aluminum, polymer, paper-based honeycomb, extruded honeycomb, macro-polymeric foam, micro-polymeric foam, nano-cellular polymeric foam, multi-wall thermoplastic, and/or any combination of such materials. Foam material 164 is lighter weight than other known materials such as steel. For example, foam material 164 may be an ultra low-density polymer foam that is less than approximately 40 kg/m$^3$ wherein steel may have a weight of approximately 1000 kg/m$^3$. As such, foam material composite system 164 has a material weight advantage of approximately 40% to 60% when compared to steel.

As shown in FIG. 6, shell casing 150 not only includes skins 158 and 160, but also includes a reinforcing composite material 166 extending therebetween. Composite material 166 is any suitable material such as, but not limited to, a steel, aluminum, carbon, glass, aramid, polymer fiber prepreg and thermoset or thermoplastics based laminates, hybrid steel and aluminum, titanium, high performance polymer, ceramic material coated sheets, and/or any combination thereof. A plurality of reinforcing bands 168 are spaced substantially uniformly throughout material 166 to facilitate increasing a bending or curved shell stiffness of shell casing 150. Reinforcing bands 168 may be fabricated from any suitable material such as, but not limited to, a steel material, aluminum, Carbon fiber prepreg based laminates, Hybrid steel and aluminum, titanium, high performance polymer, ceramic material coated sheets and/or combination thereof. The reinforcing bands 168 are at least one of, but not limited to, a corrugated reinforcement 174 (shown in FIG. 6), a double wall reinforcement 176 (shown in FIG. 7), and/or a triple wall reinforcement 178 (shown in FIG. 8).

In the exemplary embodiment, when shell casing 150 is fabricated from composite material, shell casing 150 may include an integral skin (not shown). In one embodiment, the integral skin may include a bonded material extending across at least one of its surfaces such that skin 158, skin 160, and a reinforcement are fabricated separately and subsequently bonded together using adhesives. The reinforcement may be fabricated from a fiber and/or a woven cloth. Alternatively, the reinforcement is fabricated from any suitable material that enables casing 150 to function as described herein. When skins 158 and 160 and the reinforcement are bonded together, each is overlapped to a sufficient length.

As shown in FIG. 9, casing 150 includes skins 158 and 160 and at least one reinforcing composite material 180 extending therebetween. Moreover, casing 150 includes a separation skin 182 that extends between skin 158 and 160 such that reinforcing composite material 180 is partitioned into a radially outer portion 184 and a radially inner portion 186. Each of the radially outer and radially inner portions 184 and 186 includes a plurality of reinforcing bands 188 and 190, respectively. In the exemplary embodiment, bands 188 and 190 substantially spaced uniformly within radially outer and radially inner portions 184 and 186 to facilitate increasing the bending stiffness of shell casing 150. Alternatively, reinforcing bands 188 and 190 are spaced non-uniformly within portions 184 and 186. In the exemplary embodiment, reinforcing bands 188 and 190 are corrugated. Alternatively, each reinforcing band 188 and 190 may be a double wall reinforcement 192 (shown in FIG. 10), and/or a triple wall reinforcement (not shown). Alternatively, portions 184 and 186 may include other types of reinforcements. Moreover, in the exemplary embodiment, reinforcing bands 188 and 190 are staggered within outer and inner portions 184 and 186 such that respective edges 194 and 196 of each band are aligned non-linearly with respect to one another. Alternatively, reinforcing bands 188 and 190 may be positioned at any relative location that enables casing 150 to function as described herein, such as, but not limited to being positioned such that respective edges 194 and 196 of each reinforcing band 188 and 190 are substantially co-linearly aligned with respect to one another.

During assembly, in the exemplary embodiment, shell casing 150 is fabricated using resin transfer molding process. The resin transfer molding process includes a preform placement of reinforcement material inside a mold. A resin is transferred into the mold through an inlet such that the resin is transferred to the reinforcement. During the resin transfer molding process, an outlet allows the mold to be completed filled to form casing 150 and vents out any volatiles emitted during the process. Moreover, the resin is injected under a pressure that is greater than the atmospheric pressure. Alternatively, the resin is injected under a vacuum. In an alternative embodiment, shell casing 150 is fabricated using at least one of, but not limited to, a modular hand lay-up process, a compression molding process, a resin infusion process, a resin transfer molding process, a vacuum assisted molding process, and/or an autoclaving process, or any combination thereof.

A thermoplastic resin in the form of a film, a powder, and/or co-mingled fibers with the reinforcement may be formed as a preform and may be consolidated as a solid part by applying thermal, mechanical, electrical and/or magnetic forces.

Moreover, a vacuum or pressure backing method may also be used during fabrication. When vacuum or pressure backing is used, casing 150 may also be bonded.

Alternatively, an autoclaving method of composite fabrication may be used for fabricating casing 150 and/or any components thereof. The autoclave method may be used in a modified form such that a sacrificial foam material would also be used to fabricated casing 150.

Once shell casing 150 is fabricated from composite material, shell portions 106 and 108 may be coupled together using a plurality of suitable methods. For example, shell portions 106 and 108 may be coupled together using at least one of, but not limited to, bolts, tongue-in-groove joints, and/or any combination thereof. Moreover, shell portions 106 and 108 may be coupled together using any known coupling method or hardware that enables casing 150 to function as described herein, including but not limited to, an in-situ adhesive application using joint sealing.

During use, the low pressure steam turbine (LP) is coupled to the intermediate pressure (IP) and/or high pressure (HP) steam turbine that drive the generator. Within known LP turbines, expended steam is channeled into the exhaust hood from the LP turbine. The LP turbine exhaust hood facilitates separating steam under vacuum from atmospheric conditions, while providing support to rotating and stationary turbine components. The stationary components generally direct the steam towards the rotating components at a predetermined angle to facilitate rotor rotation and thus, power generation.

At least one known LP turbine exhaust hood is fabricated solely from steel material. The above-described exhaust hood is fabricated from a composite material. An exhaust hood fabricated from a composite material has a lighter overall weight than an exhaust hood fabricated solely from steel material. As such, a lighter weight exhaust hood reduces manufacturing costs while still providing a structurally sound exhaust hood. Moreover, reducing the weight of an exhaust hood reduces some of the awkwardness in assembling and transporting the exhaust hood.

Exemplary embodiments of exhaust hoods are described above in detail. The exhaust hoods and associated components are not limited to the specific embodiments described herein, but rather, components of each exhaust hood may be utilized independently and separately from other components described herein. Each exhaust hood component can also be used in combination with other exhaust hoods. While the invention has been described in terms of various specific embodiments, those skilled in the art will recognize that the invention can be practiced with modification within the spirit and scope of the claims.

What is claimed is:

1. A method of fabricating an exhaust hood for use with a turbine engine, said method comprising:

providing an upper shell casing wherein the upper shell casing is fabricated from a composite material; and coupling the upper shell casing to a lower shell casing such that a turbine is housed within the exhaust hood, the lower shell casing is fabricated from a composite material; and coupling an inner skin to a radially inner surface of the upper and lower shell casings.

2. A method in accordance with claim 1 further comprising coupling an outer skin to a radially outer surface of the upper and lower shell casings.

3. A method in accordance with claim 1 further comprising coupling a steel material to the upper and lower shell casings to facilitate supporting the exhaust hood and to facilitate preventing degradation of the upper and lower shell casings.

4. A method in accordance with claim 1 further comprising coupling a steel frame assembly to a radially outer surface of the upper and lower shell casings to facilitate supporting the exhaust hood.

5. A method in accordance with claim 1 wherein coupling the upper shell casing to the lower shell casing further comprises coupling the upper shell casing to the lower shell casing using at least one of a plurality of bolts and tongue-in-groove joints.

6. A turbine exhaust hood comprising:

a shell casing sized to house a turbine at least partially therein, said shell casing is fabricated from a composite material, wherein said shell casing further comprises an inner skin coupled to a radially inner surface of said shell casing.

7. A turbine assembly comprising:

a turbine; and an exhaust hood such that said turbine housed at least partially within said exhaust hood, said exhaust hood comprising:

a shell casing comprising a radially inner surface and a radially outer surface, wherein an inner skin is coupled to the radially inner surface, said shell casing is fabricated from a composite material;

an external support structure coupled to said shell casing outer surface, said external support structure provides structural support to said shell casing; and an internal support structure coupled to said shell casing inner surface for channeling flow into said exhaust hood.

8. A turbine assembly in accordance with claim 7 wherein said composite material comprises a glass fiber composite, said shell casing is fabricated using a resin transfer molding process.

9. A turbine assembly in accordance with claim 7 wherein said composite material comprises at least one of a carbon fiber and matrix based composite material, an aramid fiber-based, a glass fiber, a Thermoset composite material, a thermoplastic composite material, a polymer fiber-based Thermoset matrix composite material, and a polymer fiber-based thermoplastic matrix composite material.

10. A turbine assembly in accordance with claim 7 wherein said shell casing is fabricated using at least one of a modular hand lay-up compression molding process, a resin infusion process, a resin transfer molding process, a vacuum assisted molding process, and an autoclaving process.

11. A turbine assembly in accordance with claim 7 wherein said exhaust hood further comprises a steel sheet liner coupled to a portion of said shell casing inner surface facilitates preventing degradation of said shell casing.

12. A turbine assembly in accordance with claim 7 wherein said shell casing is fabricated comprising a foam core, an inner skin coupled to said radially inner surface of said foam core, and an opposing outer skin coupled to said radially outer surface of said foam core.

13. A turbine assembly in accordance with claim 7 wherein said inner and outer skins each comprise a glass fiber polymer composite.

14. A turbine assembly in accordance with claim 7 wherein said exhaust hood comprises an outer skin coupled to a radially outer surface of the shell casing and a composite material sandwiched between said inner and outer surfaces.

15. A turbine assembly in accordance with claim 14 wherein said composite material comprises a plurality of reinforcing bands.

16. A turbine assembly in accordance with claim 15 wherein each of said plurality of reinforcing bands comprises a corrugated reinforcement extending between said outer and inner skins.

17. A turbine assembly in accordance with claim 15 wherein said plurality of reinforcing bands are oriented in a double wall construction reinforcement pattern.

18. A turbine assembly in accordance with claim 15 wherein said plurality of reinforcing bands are oriented in at least one of a triple wall and a staggered construction reinforcement pattern.

19. A turbine assembly in accordance with claim 7 wherein said exhaust hood comprises an outer skin coupled to the radially outer surface of said shell casing, a composite material extending therebetween said inner surface and said outer surface, and a reinforcing skin positioned within the composite material, said reinforcing skin separates the exhaust hood into a radially outer portion and a radially inner portion.

20. A turbine assembly in accordance with claim 19 wherein each of said radially outer and radially inner portions comprises a corrugated reinforcement.

* * * * *